US008438755B2

(12) United States Patent
Lee et al.

(10) Patent No.: US 8,438,755 B2
(45) Date of Patent: May 14, 2013

(54) LAUNDRY MACHINE

(75) Inventors: Deug Hee Lee, Gimhae-si (KR); Hung Myong Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 315 days.

(21) Appl. No.: 11/629,662

(22) PCT Filed: Apr. 18, 2006

(86) PCT No.: PCT/KR2006/001430

§ 371 (c)(1),
(2), (4) Date: Jan. 18, 2008

(87) PCT Pub. No.: WO2006/129916

PCT Pub. Date: Dec. 7, 2006

(65) Prior Publication Data

US 2008/0201866 A1 Aug. 28, 2008

(30) Foreign Application Priority Data

May 31, 2005 (KR) ..... 10-2005-0046037
May 31, 2005 (KR) ..... 10-2005-0046038
May 31, 2005 (KR) ..... 10-2005-0046040

(51) Int. Cl.
*D06F 58/02* (2006.01)
*D06F 39/04* (2006.01)

(52) U.S. Cl.
USPC ..... 34/595; 34/607; 68/5 C; 68/15

(58) Field of Classification Search ..... 68/5 C, 68/5 R, 15, 207; 34/595, 604, 607
See application file for complete search history.

(56) References Cited

U.S. PATENT DOCUMENTS

| | | | | |
|---|---|---|---|---|
| 2,562,843 | A * | 7/1951 | Grondahl | 392/312 |
| 4,207,683 | A | 6/1980 | Horton | |
| 4,484,399 | A * | 11/1984 | Biancalani | 38/77.3 |
| 4,612,090 | A * | 9/1986 | Ellis, Jr. | 202/176 |
| 5,315,727 | A * | 5/1994 | Lee | 8/159 |
| 6,161,306 | A * | 12/2000 | Clodic | 34/321 |
| 2004/0004299 | A1 * | 1/2004 | Glucksman | 261/129 |
| 2004/0107509 | A1 * | 6/2004 | Kim et al. | 8/158 |
| 2004/0187527 | A1 * | 9/2004 | Kim et al. | 68/5 C |
| 2004/0187529 | A1 | 9/2004 | Kim et al. | |
| 2005/0034250 | A1 * | 2/2005 | Oh et al. | 8/159 |

FOREIGN PATENT DOCUMENTS

| | | |
|---|---|---|
| CN | 1534129 | 10/2004 |
| DE | 577 336 | 5/1933 |
| DE | 604 415 | 10/1934 |
| DE | 100 28 944 | 12/2001 |

(Continued)

OTHER PUBLICATIONS

Official English translation of JP 61-128995, no date.*

*Primary Examiner* — Joseph L Perrin
(74) *Attorney, Agent, or Firm* — McKenna Long & Aldridge LLP

(57) ABSTRACT

A novel-structure laundry machine that is capable of washing laundry using steam is disclosed. The laundry machine includes a machine body constituting the external appearance thereof, a drum mounted in the machine body for receiving laundry, a steam supply unit mounted in the machine body for generating steam, the steam supply unit being constructed to receive water for steam generation through the water inlet port exposed to the outside while the water inlet port communicates with one side of the machine body, and a primary steam supply part for supplying the steam generated in the steam supply unit into the drum.

12 Claims, 14 Drawing Sheets

FOREIGN PATENT DOCUMENTS

| | | | | |
|---|---|---|---|---|
| EP | 0 152 745 | | | 8/1985 |
| EP | 1 275 767 | | | 1/2003 |
| EP | 1441059 | A1 | | 7/2004 |
| EP | 1441060 | A1 | | 7/2004 |
| EP | 1 464 750 | | | 10/2004 |
| EP | 1469120 | A1 | | 10/2004 |
| EP | 1 507 031 | A1 | | 2/2005 |
| EP | 1 507 032 | A1 | | 2/2005 |
| EP | 1507031 | A1 | | 2/2005 |
| GB | 799788 | | | 8/1958 |
| GB | 2021953 | | * | 12/1979 |
| JP | S61-128995 | | | 6/1986 |
| JP | 2-239894 | A | | 9/1990 |
| JP | 6-233898 | | | 8/1994 |
| KR | 10-1996-0011358 | | | 4/1996 |
| KR | 10-0128631 | | | 2/1997 |
| KR | 10-1997-0070295 | | | 11/1997 |
| KR | 10-0172877 | | | 10/1998 |
| KR | 1020030012145 | | | 2/2003 |
| KR | 10-2004-0088884 | | | 10/2004 |
| KR | 10-2005-0015758 | | | 2/2005 |
| KR | 10-2005-0017489 | | | 2/2005 |
| KR | 10-2005-0017490 | | | 2/2005 |
| KR | 10-2005-0018182 | | | 2/2005 |
| KR | 10-2005-0042127 | | | 5/2005 |
| KR | 10-2005-0045968 | | | 5/2005 |
| KR | 1020050044884 | | | 5/2005 |
| KR | 10-2005-0065721 | | | 6/2005 |
| KR | 10-2005-0093260 | | | 9/2005 |
| KR | 10-2006-0023017 | | | 3/2006 |
| WO | WO 2004/059070 | | | 7/2004 |

* cited by examiner

LAUNDRY MACHINE

This application claims priority from PCT Application PCT/KR2006/001430, filed Apr. 18, 2006, Korean Application 10-2005-0046037, filed May 31, 2005, Korean Application 10-2005-0046038, filed May 31, 2005 and Korean Application 10-2005-0046040, filed May 31, 2005, which are hereby incorporated by reference in their entirety.

TECHNICAL FIELD

The present invention relates to a laundry machine, and more particularly, to a novel-structure laundry machine that is capable of washing laundry using steam.

BACKGROUND ART

Generally, laundry machines are classified into a vertical type laundry machine, a drum of which is mounted in a vertical direction, and a horizontal type laundry machine, the drum of which is mounted in a horizontal direction. A typical example of the vertical type laundry machine is a pulsator type washing machine, and a typical example of the horizontal type laundry machine is a drum type washing machine.

However, laundry machines do not merely refer to machines that are capable of washing laundry but may include a drying machine that is capable of drying the laundry.

In the drum type washing machine, as the drum is mounted in the horizontal direction as described above, laundry received in the drum is washed by a lifting and dropping operation.

FIGS. 1 and 2 schematically illustrate the structure of a conventional drum type washing machine.

As shown in the drawings, the drum type washing machine includes a machine body 10, a tub 20 mounted in the machine body 10, a drum 30 rotatably mounted in the tub 20, and a driving unit for driving the drum 30.

At the front part of the machine body 10 is formed a laundry inlet hole 11, through which laundry is put into the drum. A door 40 is mounted to the machine body adjacent to the laundry inlet hole 11 for opening and closing the laundry inlet hole.

At opposite sides of the bottom of the outer circumference of the tub 20 are mounted dampers 21, which support the tub 20 in the machine body 10.

In the lower part of the tub 20 is mounted a washing water heater 60 for heating washing water, by which the temperature of the washing water used to wash laundry can be controlled.

The drum 30 is rotatably mounted in the tub 20. At the circumference of the drum 30 are formed a plurality of through-holes 31, through which washing water is introduced into or discharged from the drum.

The driving unit includes a driving motor 71 for driving the drum 30, and a belt 72 for transmitting the driving force of the driving motor 71 to the drum 30.

In the conventional drum type washing machine with the above-stated construction, a washing operation, a rinsing operation, and a spin-drying operation is automatically carried out for a predetermined period of time according to a control signal from a controller (not shown) while laundry and a predetermined amount of detergent are received in the drum 30, whereby the laundry is washed.

In the above-described conventional drum type washing machine, however, the amount of washing water used to wash the laundry is excessive. As a result, a large amount of washing water and power is unnecessarily consumed.

Specifically, in the conventional drum type washing machine, contaminants are not separated from the laundry unless the laundry is submerged in the washing water for a long period of time. For this reason, a large amount of washing water is needed.

Furthermore, in the case of the conventional drum type washing machine, the washing water supplied into the tub is heated by the washing water heater, and then a laundry sterilizing process is carried out using the heated washing water. As a result, the power consumption is also unnecessarily large.

In recent years, there has been proposed a drum type washing machine having an additional steam supply unit mounted therein for supplying high-temperature steam into the drum, whereby the sterilization of the laundry is accomplished only using a small amount of washing water.

However, the conventional steam supply unit has the following problems since an amount of washing water necessary to generate steam is automatically supplied.

First, an additional water supply valve and an additional water supply channel are needed to supply water to the steam supply unit.

For this reason, the manufacturing costs of the conventional drum type washing machine are increased. Furthermore, the structure of the conventional drum type washing machine is complicated, and therefore, the manufacturing efficiency of the conventional drum type washing machine is lowered.

Secondly, in the case that the water supply valve malfunctions or in the case that a sensor for detecting the water level in the steam supply unit is out of order, the heat generation is performed although the water is not sufficiently supplied, which may lead to the occurrence of a fire.

This problem is caused because a user cannot recognize the amount of washing water supplied to the steam supply unit.

In addition, the conventional steam supply unit is constructed such that the steam is injected into the drum from the top part of the drum. As a result, when the amount of the injected steam is not sufficiently large or when the injection pressure of the steam is not sufficiently high, the steam cannot be smoothly supplied to the laundry placed at the bottom of the drum. Consequently, the washing efficiency using the steam is significantly lowered.

On the other hand, it is also possible to embody a drying machine having the steam supply unit in addition to the washing machine having the steam supply unit. This drying machine not only dries laundry but also supplies the steam to wrinkled dry laundry, thereby accomplishing sterilization of the laundry and removal of wrinkles from the laundry.

However, it is necessary that this drying machine be installed at the place where the drying machine is connected to an additional external water supply facility, in addition to the above-mentioned problems.

This is because water supply is not necessary for a general drying machine, and therefore, the general drying machine is usually installed at the place where only power supply to the general drying machine is possible. Consequently, in the case that an additional water supply facility is installed to supply water to the steam supply unit, the usefulness of the drying machine including the steam supply unit is lowered.

DISCLOSURE OF INVENTION

Therefore, the present invention has been made in view of the above problems, and it is an object of the present invention to provide a novel-structure laundry machine in which a structure to supply water to a steam supply unit is improved, whereby the recognition of the amount of water supplied by a user is possible.

It is another object of the present invention to provide a novel-structure laundry machine in which steam generated in the steam supply unit is smoothly supplied to laundry placed at the bottom of a drum.

It is yet another object of the present invention to provide a laundry machine in which an additional water supply facility is not necessary in the case that water is supplied only to the steam supply unit, whereby the usefulness of the laundry machine is increased.

Additional advantages, objects, and features of the present invention will be set forth in part in the following description of preferred embodiments.

The object of the present invention can be achieved by providing a laundry machine comprising: a machine body constituting the external appearance thereof; a drum mounted in the machine body for receiving laundry; a steam supply unit mounted in the machine body for generating steam, the steam supply unit being constructed to receive water for steam generation through the water inlet port exposed to the outside while the water inlet port communicates with one side of the machine body; and a primary steam supply part for supplying the steam generated in the steam supply unit into the drum.

The laundry machine may further comprise: a tub for storing washing water, the tub having the drum rotatably mounted therein.

The primary steam supply pipe may communicate with the interior of the tub through a predetermined position of the lower circumference of the tub such that the steam can be supplied into the drum through the tub. In this case, the steam moves to the upper part of the drum from the lower part of the drum. This is because the steam is lighter than air. Consequently, once the steam is supplied to the lower part of the drum, the steam moves upward.

The tub may be provided at the lower part thereof with a storage part, which protrudes outward, the storage part having a heater for heating the washing water mounted therein. In this case, it is preferable that the predetermined position of the tub through which the primary steam supply pipe extends be lower than the bottom of the drum but be higher than the position where the heater is mounted. As a result, it is possible to prevent interference between the supplied steam and the heater and the bottom of the drum, and therefore, it is possible to more efficiently supply the steam.

The steam supply unit may include: a case for storing the water for steam generation therein, the case being constructed to receive the water for steam generation through the water inlet port; and a heater for heating the water for steam generation.

The case may be disposed at the inside upper end of the machine body. Alternatively, the case may be received in the machine body in a drawer-type inserting fashion through the front part of the machine body.

Also, the case may be disposed in the upper part of the drum or the tub. Alternatively, the case may be located approximately at a lower position than the middle part of the machine body in the machine body. Of course, the case may be located approximately at a lower position than the bottom of the drum.

In the case that the case is mounted in the machine body, and therefore, the water inlet port is separated from the case, it is preferable that the laundry machine further comprise a water inlet pipe. The water inlet pipe has one end communicating with the water inlet port and the other end communicating with the case such that water for steam generation is supplied to the case from the water inlet port.

Also, it is preferable that the water inlet port selectively communicate with the outside through a cover part. Preferably, the case is provided with an overflow pipe for allowing oversupplied water to overflow therethrough.

Preferably, one end of the overflow pipe communicates with the case at the position of the case corresponding to the oversupplied water level, and the other end of the overflow pipe communicates with at least one of the drum, the tub, and a water drainage pipe for draining the water from the tub.

On the other hand, it is preferable that the laundry machine further comprise a water level detection part for detecting the water level of water received in the case. Also, it is preferable that the heater be controlled based on the water level detected by the water level detection part. The water level detection part may include an electrode sensor having at least two electrodes.

Also, it is preferable that the laundry machine further comprise a water level display part for informing a user of the information detected by the water level detection part.

The laundry machine may further comprise an auxiliary steam supply part for supplying the steam generated in the steam generation unit to the upper side of the drum in addition to the primary steam supply unit.

Preferably, the auxiliary steam supply part is an auxiliary steam supply pipe diverging from the primary steam supply part. Also preferably, the laundry machine further comprises a flow direction control valve mounted at the region where the auxiliary steam supply pipe diverges from the primary steam supply pipe for selectively opening and closing the respective pipe lines or controlling the opening degree of the respective pipe lines.

Preferably, the laundry machine further comprises a washing water circulation unit for circulating the washing water received in the tub such that the washing water can be supplied into the drum.

Preferably, the washing water circulation unit includes: an inlet pipe for receiving the washing water from the tub; a circulating pump mounted on the pipe line of the inlet pipe for pumping the washing water; and a guide pipe for supplying the washing water pumped by the circulating pump into the drum.

Preferably, the laundry machine further comprises injection nozzles disposed at the end of the auxiliary steam supply pipe and the end of the guide pipe for injecting the steam and the washing water, respectively, the injection nozzles extending through a gasket such that the injection nozzles can communicate with the upper side of the drum.

In another aspect of the present invention, provided herein is a control method of a laundry machine, comprising the steps of: (a) checking the water level of water for steam generation in a case of a steam supply unit; and (b) when the water level checked at step (a) is higher than a predetermined water level, controlling a heater to generate steam, and, when the water level checked at step (a) is lower than the predetermined water level, requesting a user to supply water to the steam supply unit.

Preferably, the control method further comprises the steps of: (c) supplying the steam generated at step (b) to the lower side of the tub. Also, the control method may further comprise the steps of: (d) selectively supplying the steam generated at step (b) to the upper side of the drum. Preferably, step (d) is carried out according to the user's selection as needed.

On the other hand, it is preferable that the control method further comprise the steps of: supplying washing water to the tub at least prior to step (c). Also preferably, the control method further comprises the steps of: (e) circulating the supplied washing water and injecting the circulated washing water into the drum.

Furthermore, it is preferable that the control method further comprise the steps of: rotating the drum in the course of carrying out step (c) or step (e).

According to the present invention, the structure for supplying water to the steam supply unit is modified such that the user can directly supply water to the steam supply unit. As a result, the further provision of a water supply valve is unnecessary, and at the same time, a water supply channel is omitted. Consequently, the manufacturing costs of the laundry machine are reduced, and the manufacturing efficiency of the laundry machine is improved.

Also, in the case that the laundry machine requires water supply only to the steam supply unit, the laundry machine can be installed at the area where an external water supply facility is not provided. Consequently, the usefulness of the laundry machine is increased.

Furthermore, the amount of water supplied to the steam supply unit can be directly recognized by the user. As a result, the user can easily cope with the relevant problems even when the water level sensor malfunctions or is out of order. Consequently, the overheating due to the shortage of water for steam generation and the occurrence of a fire due to the overheating are effectively prevented.

In the laundry machine according to the preferred embodiment of the present invention, on the other hand, the steam generated in the steam supply unit can be supplied into the drum through the bottom space of the tub, and therefore, the steam can be smoothly supplied to the laundry placed at the bottom of the drum. Consequently, the washing efficiency using the steam is maximized.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in FIGS. 3 to 15.

Figure 1:
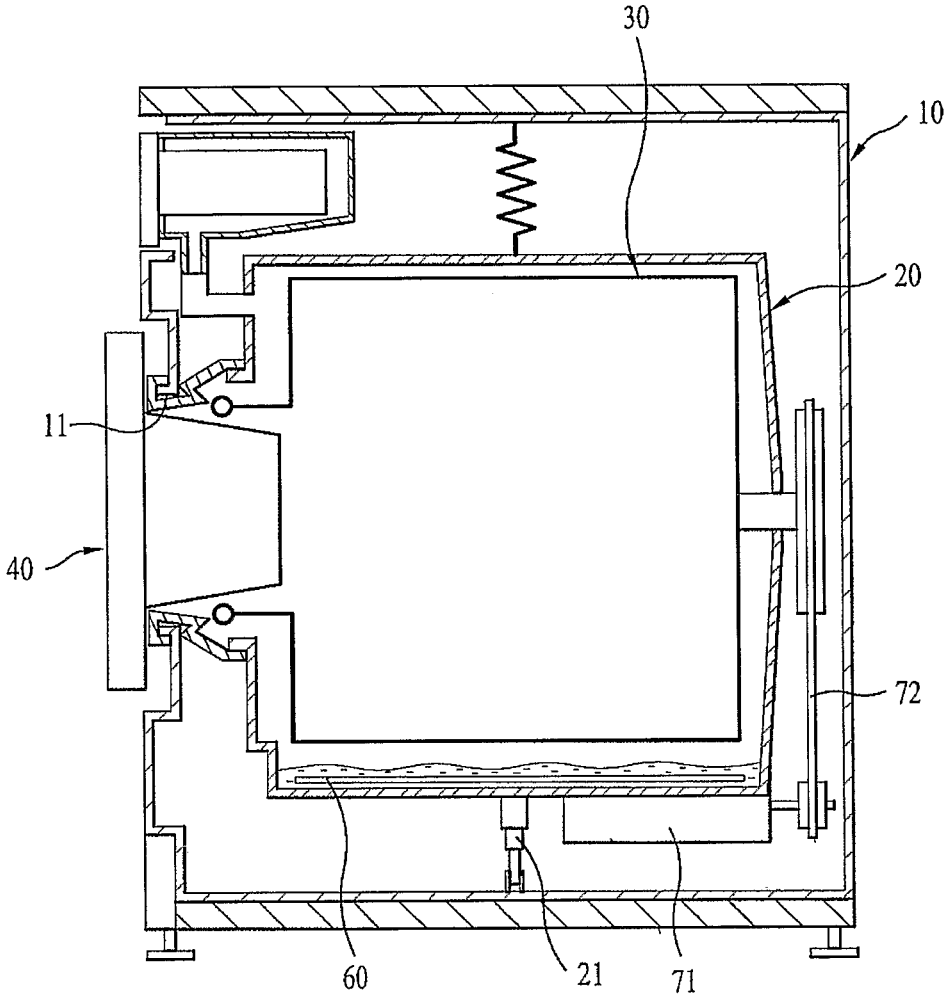
FIG. 1 is a side view, in section, illustrating the interior structure of a conventional drum type washing machine.
Figure 2:
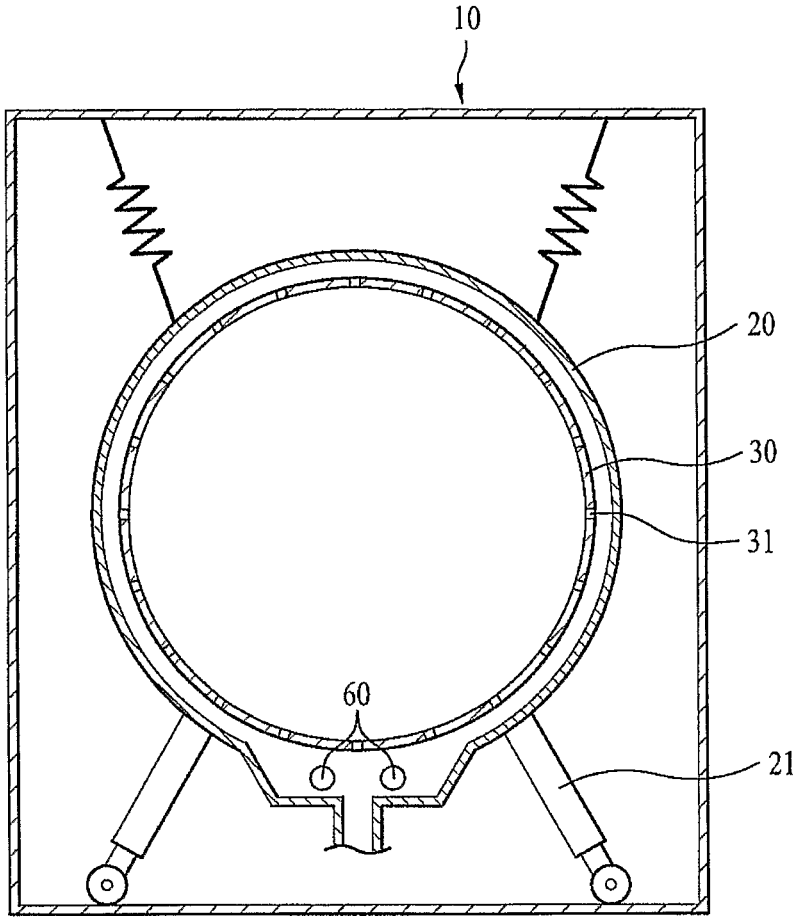
FIG. 2 is a front view, in section, illustrating the interior structure of the conventional drum type washing machine.
Figure 3:
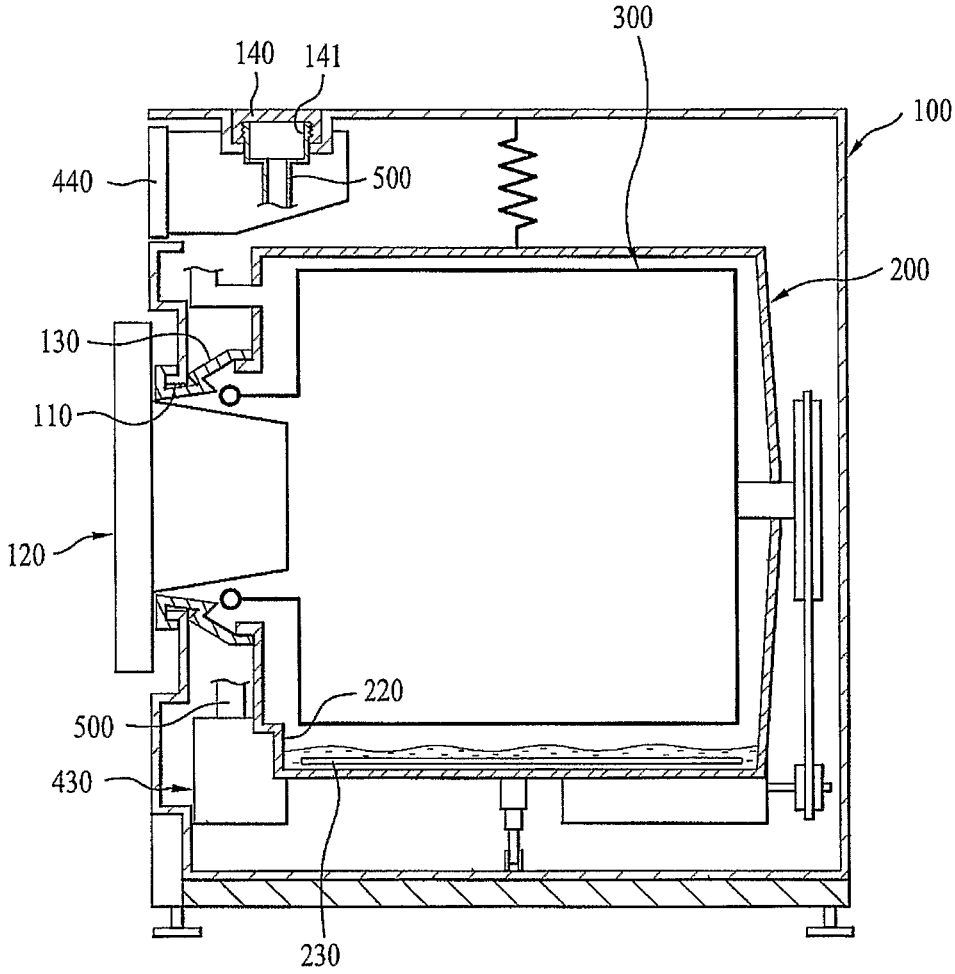
FIG. 3 is a side view, in section, illustrating the interior structure of a laundry machine according to a first preferred embodiment of the present invention.
Figure 4:
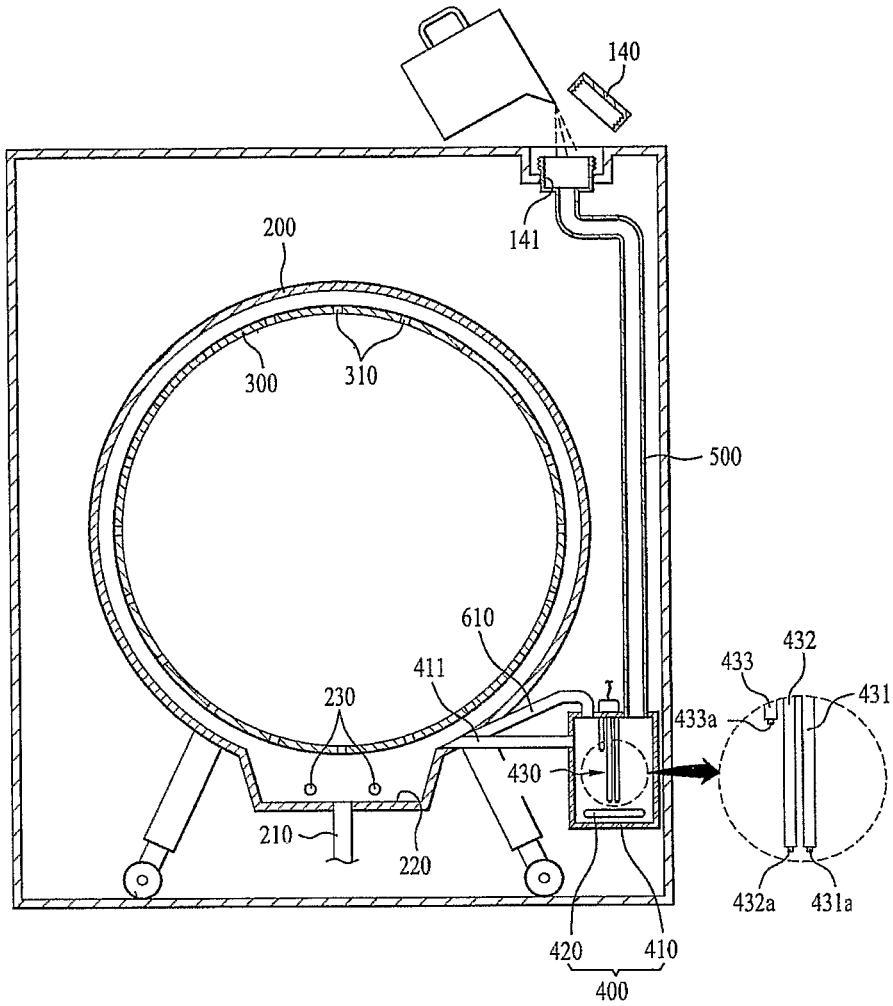
FIG. 4 is a front view, in section, illustrating the interior structure of the laundry machine according to the first preferred embodiment of the present invention.

First, FIGS. 3 and 4 illustrate a laundry machine according to a first preferred embodiment of the present invention.

Specifically, the laundry machine according to the first preferred embodiment of the present invention includes a machine body 100, a tub 200, a drum 300, a steam supply unit 400, a water inlet port 141, a water inlet pipe 500, and a primary steam supply pipe 610. In this embodiment, the laundry machine is a drum type washing machine. In the case that the laundry machine is a drying machine, the tub, in which washing water is received, is not necessarily provided for the drying machine.

The machine body 100 constitutes the external appearance of the drum type washing machine. At the front part of the machine body 100 is formed a laundry inlet hole 110. The tub 200 is mounted in the machine body 100 in a supported state.

A door 120 is mounted to the machine body 100 adjacent to the laundry inlet hole 110 for opening and closing the laundry inlet hole 110.

To the lower part of the tub 200 is connected a water drainage pipe 210, through which washing water (or cleansing water) is drained.

At the lower part of the tub 200, to which the water drainage pipe 210 is connected, is formed a storage part 220, which protrudes outward. In the storage part 220 is mounted a heater 230.

Preferably, a temperature sensor (not shown) is further located in the space where the heater 230 is located because the temperature of the washing water heated by the heater 230 can be accurately detected by the temperature sensor.

The drum 300 is rotatably mounted in the tub 200, and is disposed such that the open side of the drum 300 is directed to the laundry inlet hole 110 of the machine body 100.

At the circumference of the drum 300 are formed a plurality of through-holes 310, through which washing water and steam supplied into the tub 200 are introduced into the drum 300.

Between the laundry inlet hole 110 of the machine body 100 and the front end of the drum 300 is mounted a gasket 130, by which the space defined between the laundry inlet hole 110 of the machine body 100 and the front end of the drum 300 is partitioned from the inner space of the machine body 100.

The steam supply unit 400 is mounted in the machine body 100 for generating a predetermined amount of steam.

The steam supply unit 400 is constructed to evaporate water using high-temperature heat. As shown in FIG. 4, the steam supply unit 400 includes a case 410 and a heater 420.

The case 410 is located approximately at the same height as or lower than the middle part of the machine body 100 in the machine body 100.

This structure is provided in consideration of the fact that the discharge pressure of upward-flowing high-temperature steam is greater than the discharge pressure of downward-flowing high-temperature steam. This is because steam is generally lighter than air.

Specifically, the case 410, in which the steam is substantially generated, is located at a predetermined position approximately below the middle part of the machine body 100 in the machine body 100 such that the steam generated in the case 410 can be discharged while the steam flows upward, whereby the discharge of the steam is more smoothly performed.

Preferably, the case 410 is located approximately at the same height as or lower than the bottom of the drum 300 in the machine body 100.

This structure is provided in consideration of the fact that the distance between the opposite sides of the machine body 100 and the tub 200 is very small, and therefore, it is very difficult to mount the case to the corresponding area.

Of course, it is possible to locate the steam supply unit 400 at the lowermost height of the machine body such that the steam generated in the steam supply unit 400 can be more smoothly injected.

Also, the heater 420 is constructed to heat the water stored in the case 410 such that the water is evaporated into steam. The heater 420 is disposed in the case 410.

In consideration of the fact that it is not easy to check the inside of the case 410, it is preferable that the above-described steam supply unit 400 be further provided with a water level detection part 430 for detecting the water level of water stored in the case 410, and the machine body 100 be further provided with a water level display part 440 for informing a user of the information detected by the water level detection part 430.

The water level detection part 430 is constructed using at least one of an electrode sensor for detecting the current water level using at least two electrodes, a temperature sensor for detecting the current water level based on the change of temperature difference, a weight sensor for detecting the current water level based on the change of weight difference, and a pressure sensor for detecting the current water level based on the change of pressure difference.

In this embodiment, the water level detection part 430 is constructed using the electrode sensor.

The water level detection part 430 includes a common electrode 431 located at a predetermined position in the case 410, a low water level detecting electrode 432, and a high water level detecting electrode 433. Of course, the water level detection part 430 may include three or more electrodes.

The low water level detecting electrode 432 has an exposed terminal 432*a*, which is located at the same height as the exposed terminal 431*a* of the common electrode 431. The high water level detecting electrode 433 has an exposed terminal 433*a*, which is located higher than the exposed terminal 431*a* of the common electrode 431 and the exposed terminal 432*a* of the low water level detecting electrode 432.

The water level display part 440 is constructed using at least one of a plurality of LEDs, an LCD, and a speaker for outputting a warning sound to inform the current water level.

Figure 5:
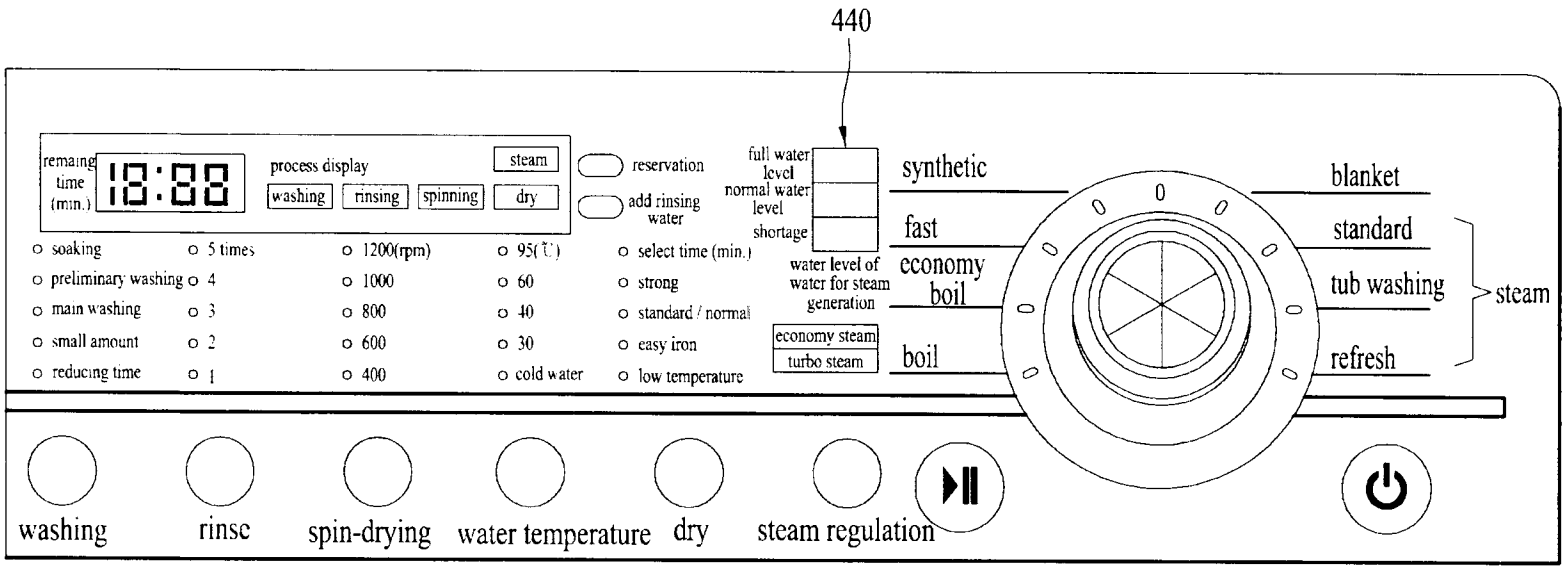
FIG. 5 is a state view schematically illustrating a control panel of the laundry machine according to the first preferred embodiment of the present invention.

In the first preferred embodiment of the present invention, the water level display part 440 includes a plurality of LEDs 441*a*, 441*b*, and 441*c*, and a display window 442, which is selectively activated by the flickering of the respective LEDs 441*a*, 441*b*, and 441*c*. As shown in FIG. 5, the respective LEDs 441*a*, 441*b*, and 441*c*, and the display window 442 are disposed on a control panel of the machine body 100.

The LED 441*a* serves to display the minimum water level, the LED 441*b* serves to display the normal water level, and the LED 441*c* serves to display the maximum water level.

Of course, the flickering of the respective LEDs 441*a*, 441*b*, and 441*c* is controlled by a control unit, which is not shown, based on the information detected by the water level detection part 430.

The water inlet pipe 500 is a pipe constructed to supply water to the case 410 from the outside of the machine body 100.

The water inlet pipe 500 communicates with the water inlet port 410. Preferably, the water inlet port is exposed to the outside while the water inlet port communicates with the outer surface of the machine body 110, especially, the upper surface of the machine body 110, such that a user can easily supply water through the water inlet port.

Of course, it is most preferable that the water inlet port 410 not protrude outward above the upper surface of the machine body 100.

This is to prevent the occurrence of trouble in cleaning the upper surface of the machine body 100 and using the washing machine due to the water inlet port.

Especially, it is preferable to further provide a cover part 140 for selectively covering the water inlet port 410. In this case, it is preferable that the cover part 140 be formed in the shape of a stopper to close the water inlet pipe 500.

Of course, although not shown in the drawings, the cover part 140 may be constructed such that the cover part 140 can be hingedly coupled to the machine body, or can slide along the corresponding area to selectively open or close the water inlet pipe 500.

The primary steam supply pipe 610 is a pipe constructed to supply the steam generated in the steam supply unit 400 into the tub 200.

Preferably, one end of the primary steam supply pipe 610 is connected to the upper end or the upper surface of the case 410 of the steam supply unit 400, and the other end of the primary steam supply pipe 610 is connected to the tub 200 such that the other end of the primary steam supply pipe 610 extends through a predetermined position at the lower circumference of the tub 200, which is lower than the bottom of the drum 300, and communicates with the interior of the tub 200.

Especially, it is most preferable that the other end of the primary steam supply pipe 610 is located lower than the bottom of the drum 300 at the lower circumference of the tub 200 but is located higher than the heater 230 disposed in the storage part 220 of the tub.

This structure provides an advantage in that the steam can uniformly flow to the whole area in the drum 300.

Specifically, in consideration of the fact that the steam is present in a high-temperature state, and high-temperature steam flows to relatively high positions, when the steam is supplied into the drum 300 from the bottom of the tub 200, the steam can be uniformly supplied to the upper space of the drum 300 as well as the bottom part of the drum 300.

Also, it is possible to prevent interference between the supplied steam and the heater disposed in the storage part and the lower part of the drum by the provision of this structure.

This structure solves the problem of the conventional art that the steam supplied from the top part of the drum cannot be uniformly supplied to the bottom of the drum.

Especially, in consideration of the fact that laundry is located at the bottom of the drum 300, the steam is supplied from the bottom of the drum 300, and therefore, the steam supply route is further shortened. Consequently, the steam supply effect is increased.

Since the steam supply unit 400 of the laundry machine according to the first preferred embodiment of the present invention as described above is constructed such that the user directly supplies water to the steam supply unit 400, the water may be oversupplied due to a mistake of the user, and, as a result, the water may overflow.

Of course, the laundry machine according to the first preferred embodiment of the present invention includes the water level detection part 430 for detecting the water level in the case 410 and the water level display part 440 for displaying information of the water level detected by the water level detection part 430. However, in the case that the water level detection part 430 is out of order, a serious problem is caused.

For this reason, the laundry machine according to the first preferred embodiment of the present invention may further include an overflow pipe 411, which is connected to the case 410 for allowing the oversupplied water to naturally overflow therethrough.

One end of the overflow pipe 411 is connected to the case 410 at the position of the case 410 corresponding to the oversupplied water level such that the overflow pipe 411 communicates with the case 410, and the other end of the overflow pipe 411 is connected to the bottom-side space of the tub 200 such that the overflow pipe 411 communicates with the tub 200.

Of course, the other end of the overflow pipe 411 may be connected to the drum 300 such that the overflow pipe 411 communicates with the interior of the drum 300. In this case, however, the laundry placed in the drum 300 may be wetted by the water overflowing through the overflow pipe 411. Of course, in the case that the laundry is to be washed according to the general washing process, it does not matter if the laundry is wetted by the oversupplied water. However, in the case that the laundry has already been washed and dried, it is necessary for the laundry not to be wetted by the oversupplied water.

Alternatively, the other end of the overflow pipe 411 may be connected to the water drainage pipe 210 such that the overflow pipe 411 communicates with the water drainage pipe 210. In this case, however, the steam generated by the operation of the steam supply unit 400 may be directly discharged to the water drainage pipe 210 through the overflow pipe 411, which is not preferable.

Consequently, it is most preferable to connect the water outlet side of the overflow pipe 411 to the tub 200 such that the overflow pipe 411 can communicate with the inside of the tub 200, especially, the bottom-side space of the tub 200.

Of course, the above-described overflow pipe 411 may be formed using an additional pipe different from the primary steam supply pipe 610 as shown in the drawings of the first preferred embodiment of the present invention. Although not shown, however, the primary steam supply pipe 610 may be constructed such that the primary steam supply pipe 610 can also serve as the overflow pipe 411.

Figure 17:
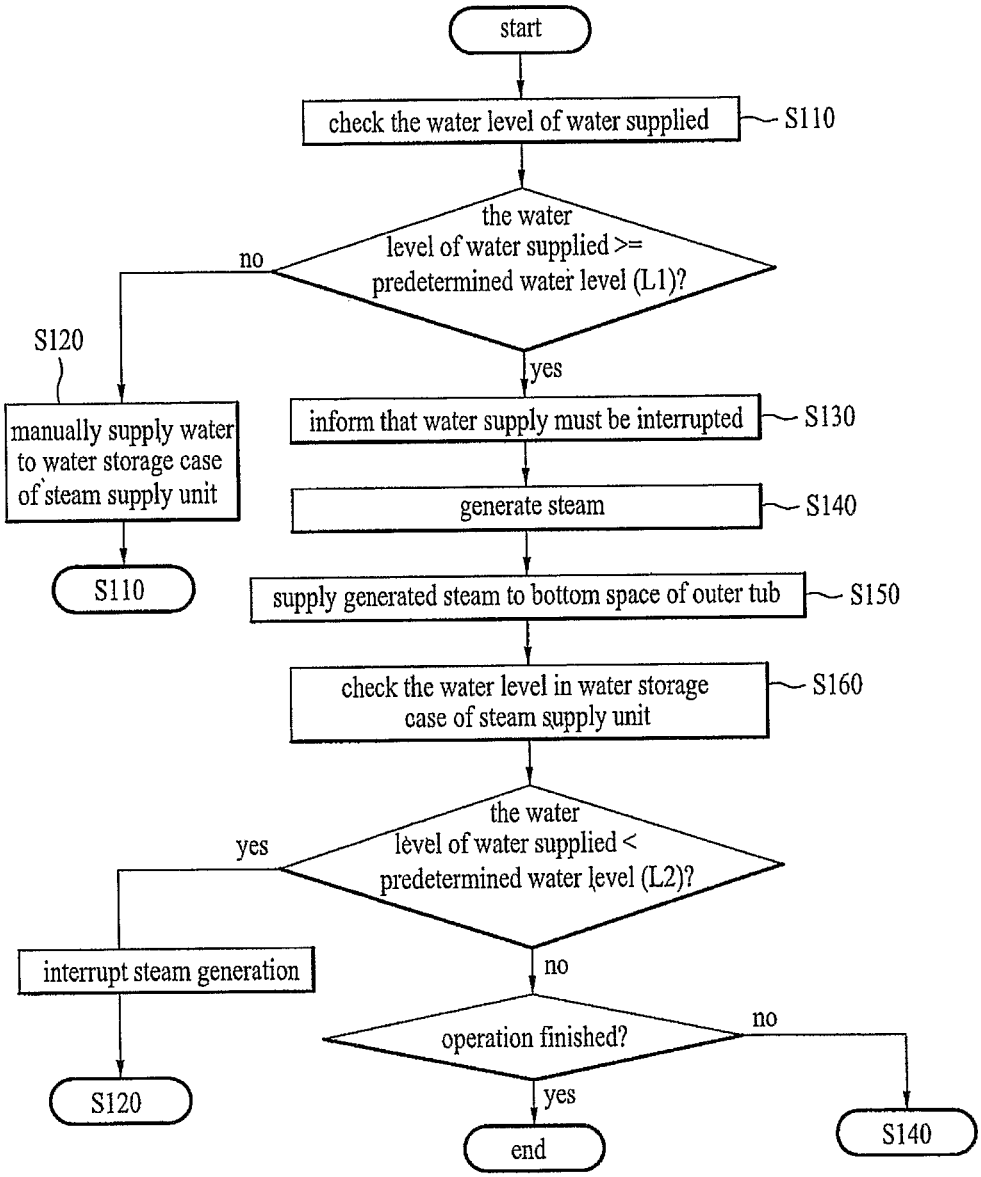
FIG. 17 is a flow chart schematically illustrating a washing method according to the present invention.

A control method of supplying steam into the drum 300 in a washing process using the laundry machine with the above-stated construction according to the preferred embodiment of the present invention will be described in more detail with reference to FIG. 17.

First, operations using the steam in the respective washing processes include various operations, such as a laundry wetting operation, a soaking operation, a washing operation, a sterilizing operation, and a post-drying operation.

In the case that the supply of steam is necessary for any one of the operations, the cover part 140, which is exposed to the outside, is manipulated through the upper surface of the machine body 100 such that the water inlet port 410 is opened, and then water is supplied through the water inlet pipe 500.

The water supplied to the water inlet port 410 flows along the water inlet pipe 500, and is then supplied into the case 410, which is connected to the other end of the water inlet pipe 500.

At this time, the water level detection part 430 disposed in the case 410 continuously detects the water level of water supplied into the case 410 to check the water level (S110).

The detection of the water level by the water level detection part 430 is performed by checking whether electrical conduction between the common electrode 431 and the low water level detecting electrode 432 has been accomplished and electrical conduction between the common electrode 431 and the high water level detecting electrode 433 has been accomplished.

The information of whether the electrical conduction has been accomplished is transmitted to the control unit (not shown), which controls the flickering of the respective LEDs of the water level display part 440 based on the information of whether the electrical conduction has been accomplished such that a user can recognize the current water level.

Figure 6:
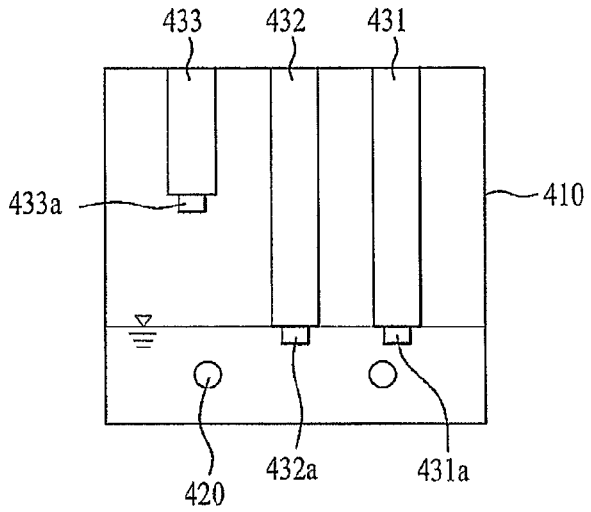
FIGS. 6 and 7 are state views illustrating the detection of water level formed by a water level detection part of the laundry machine according to the first preferred embodiment of the present invention.
Figure 8:
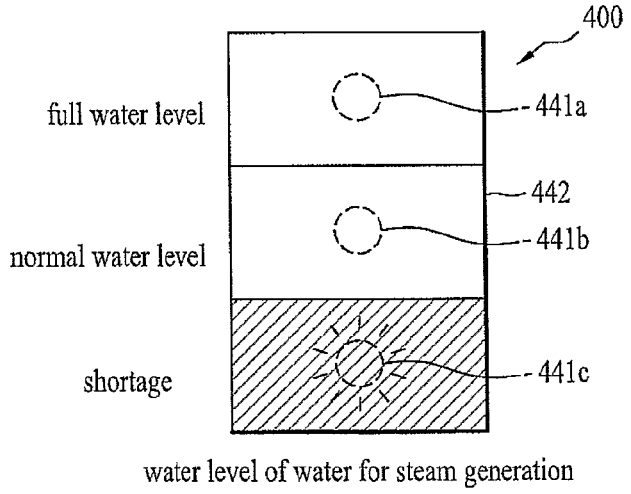
FIGS. 8 and 9 are state views illustrating the display of the detected water level performed by a water level display part of the laundry machine according to the first preferred embodiment of the present invention.

For example, in the case that the electrical conduction between the common electrode 431 and the low water level detecting electrode 432 has been accomplished, as shown in FIG. 6, a corresponding signal is transmitted to the control unit, which determines that the current water level in the case 410 is the minimum water level (a level higher than the heater) based on the information of whether the electrical conduction has been accomplished, and lights the specific LED 441*c*, which indicates the minimum water level, of the respective LEDs 441*a*, 441*b*, and 441*c*, as shown in FIG. 8, whereby the user can recognize the current water level.

Figure 7:
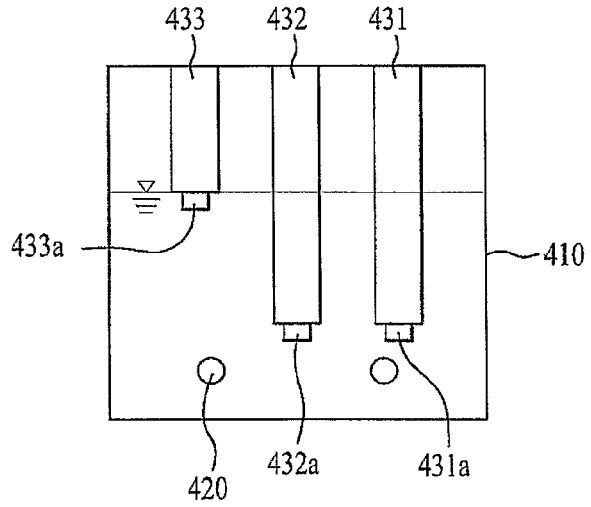
Figure 9:
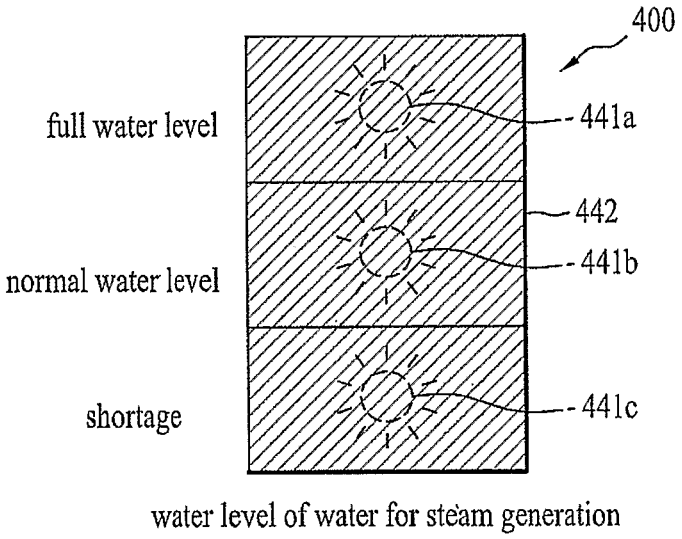

On the other hand, in the case that the electrical conduction between the common electrode 431 and the high water level detecting electrode 433 has been accomplished, as shown in FIG. 7, a corresponding signal is transmitted to the control unit, which determines that the current water level in the case 410 is the maximum water level (full water level) based on the information of whether the electrical conduction has been accomplished, and lights the specific LED 441*a*, which indicates the maximum water level, of the respective LEDs 441*a*, 441*b*, and 441*c*, as shown in FIG. 9, whereby the user can recognize the current water level.

Of course, the water oversupplied in the course of supplying water into the case 410 is discharged into the tub 200 through the overflow pipe 411 connected to the case 410 such that the overflow pipe 411 communicates with the case 410. Consequently, no problem is caused due to the oversupplied water.

After the water level in the case reaches the maximum water level through the above-described process, the cover part 140 is closed, and the corresponding operation is carried out.

Here, the control unit determines whether the checked water level for steam generation is higher or lower than the predetermined water level, and performs a control operation for steam generation or request of water supply based on the result of the determination.

For example, in the case that the checked water level for steam generation is lower than the predetermined water level, the control unit requests the user to supply water for steam generation such that the water for steam generation is manually supplied into the water storage case 410 of the steam supply unit 400 (S120).

At this time, requesting the user to supply water for steam generation is preferably accomplished by providing information, through the display screen on the control panel, of the fact that the water for steam generation is insufficient and displaying a message requesting to supply water for steam generation.

Of course, the respective LEDs 441*a*, 441*b*, and 441*c* of the water level display part 440 are repeatedly flickered such that the user can recognize the shortage of the water for steam generation.

In this case, the user manipulates the cover part 140, which is exposed to the outside, through the upper surface of the machine body 100 to open the water inlet pipe 500, and supplies water for steam generation to the water inlet pipe 500.

The water for steam generation, which has been supplied to the water inlet pipe 500, flows along the water inlet pipe 500, and is then supplied into the water storage case 410, which is connected to the other end of the water inlet pipe 500.

Even at this time, the control unit continuously checks the water level of the water for steam generation supplied into the water storage case 410 based on the information of the electrical conduction checked by the water level detection part 430, and, when the water level of the water for steam generation reaches the predetermined water level, the control unit informs the user that the water supply must be interrupted.

At this time, informing the user that the water supply must be interrupted is identical to requesting to further supply water. Specifically, informing the user that the water supply must be interrupted is accomplished by providing information, through the display screen on the control panel, of the fact that the water level of the water for steam generation has reached the maximum water level and displaying a message requesting to interrupt the supply of water for steam generation.

After the water level of water for steam generation has reached the maximum water level through the above-described process (the process of further supplying water) with the result that the water supply is interrupted, and the water inlet pipe 500 is closed by the cover part 140 (or in the case that initial water for steam generation has been supplied to the maximum water level), the control unit controls the heater 420 to generate steam (S140).

In this case, the water for steam generation stored in the water storage case 410 is evaporated by high-temperature heat emitted from the heater 420. As a result, steam is generated in the water storage case 410.

The steam generated as described above is supplied into the outer tub 200 through the primary steam supply pipe 610, which communicates with the water storage case 410 (S150).

At this time, the primary steam supply pipe 610 is connected to the outer tub 200 such that the primary steam supply pipe 610 communicates with the bottom space of the outer tub 200. Consequently, the steam is supplied from the water storage case 410 to the bottom space of the outer tub 200 through the primary steam supply pipe 610.

Subsequently, the steam flows upward from the bottom space of the outer tub 200, and is then supplied into the drum 300.

In the course of supplying the steam into the drum 300 through the above-described process, the water level of the water for steam generation in the water storage case 410 is continuously checked by the control unit.

Specifically, the control unit continuously checks the water level of the water for steam generation through the water level detection part 430 in the course of controlling the steam to be generated.

This is because, if the water level of the water for steam generation is lower than the heater 420, the temperature of the heater 420 is abruptly increased, since the heater 420 is exposed to the atmosphere, and therefore, a fire may occur.

At this time, detection of the water level of the water for steam generation by the water level detection part 430 is identical to the above-described detection method, and therefore, a detailed description thereof will not be given.

Of course, it is most preferable that the water level of the water for steam generation continuously checked through the above-described process be displayed through the water level display part 440, whereby the user can recognize the current water level in real time.

If the result of checking the water level of the water for steam generation reveals that the water level of the water for steam generation is lower than the predetermined water level, the control unit interrupts the heat emission from the heater 420, and, at the same time, requests the user to further supply water for steam generation.

At this time, requesting the user to supply the water for steam generation is possible by providing information, through the display screen on the control panel, of the fact that the water for steam generation is insufficient and displaying a message requesting to supply water for steam generation, as described above.

After the water is further supplied by the user, the control unit controls the above-described process to be continuously repeatedly carried out through the determination of the water level of the water for steam generation supplied.

As a result, the washing efficiency of the laundry in the drum is further improved by virtue of the steam supplied as described above, and the laundry placed at the bottom side in the drum 300 is smoothly washed by the steam flowing forward from the bottom side of the drum 300.

At this time, the laundry placed at the bottom side in the drum 300 is washed or sterilized, for example, in a steaming fashion.

When the corresponding operation is terminated during the above-described process, the control unit interrupts the rotation of the drum 300, the driving of a circulating pump 720, and the heat emission of the heater 420, and terminates the corresponding operation.

Meanwhile, the above-described first preferred embodiment of the present invention is constructed such that the steam is supplied only into the bottom space of the drum 300 through the bottom of the tub 200.

Consequently, the amount of the steam actually supplied to the upper space of the drum 300 is remarkably small due to the laundry placed in the bottom space of the drum 300. As a result, the steam cannot be uniformly supplied to the upper and lower parts of the laundry, and therefore, the washing efficiency is lowered.

Figure 10:
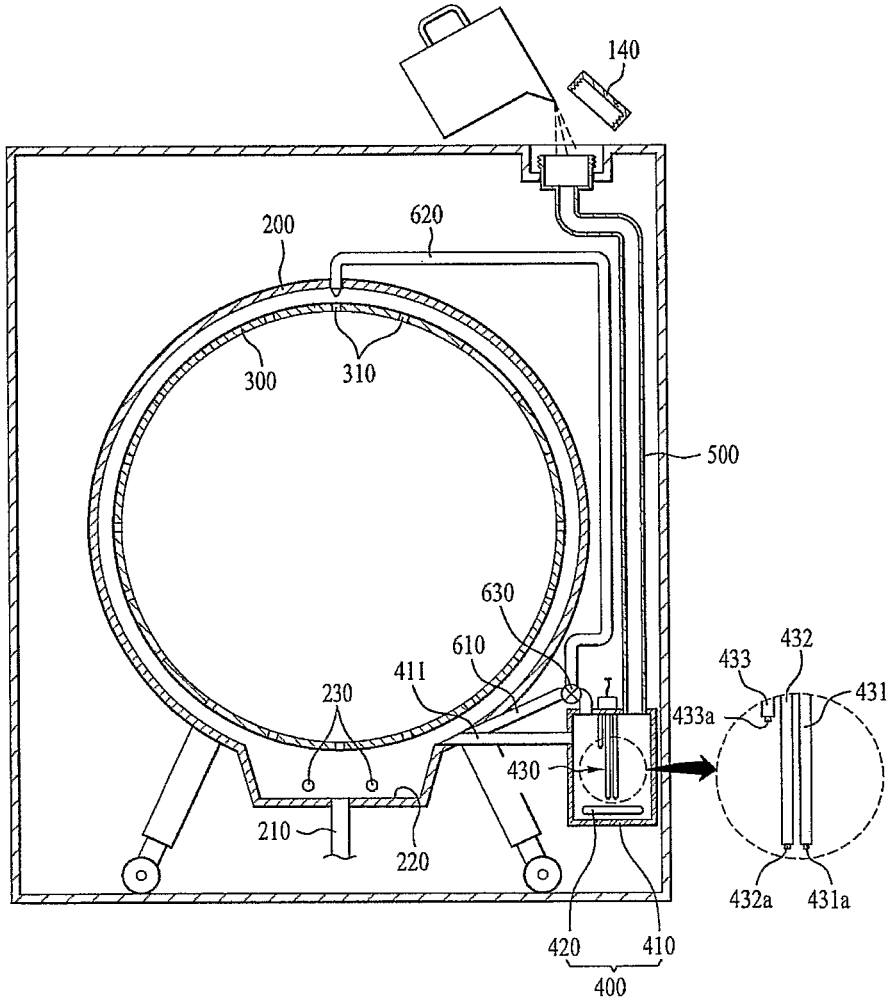
FIG. 10 is a front view, in section, illustrating the interior structure of a modified example of the laundry machine according to the first preferred embodiment of the present invention.

To solve the above-mentioned problem, the laundry machine according to the first preferred embodiment of the present invention may further comprise an additional auxiliary steam supply part 620, as shown in FIG. 10, in addition to the above-described structure of the laundry machine according to the first preferred embodiment of the present invention. Specifically, the auxiliary steam supply part may be an auxiliary steam supply pipe.

The primary steam supply pipe 610, which supplies the steam generated in the steam supply unit 400 into the tub 200, is connected to the tub in such a manner that the steam can be supplied into the drum 300 through the bottom space of the tub 200. The auxiliary steam supply pipe 620 is constructed such that the steam generated in the steam supply unit 400 can be injected toward the bottom-side space of the drum 300 from the top-side space of the drum 300.

At the end of the auxiliary steam supply pipe is provided an injection nozzle for injecting steam.

Most preferably, the discharge end of the auxiliary steam supply pipe 620 extends through the gasket 130 such that the auxiliary steam supply pipe communicates with the interior of the drum 300.

Especially, it is preferable that the auxiliary steam supply pipe 620 diverge from a predetermined region of the pipe line of the primary steam supply pipe 610. This construction minimizes the pipe line extending from the steam supply unit 400, and therefore, the line distribution is simplified.

In this case, it is preferable that a flow direction control valve 630 for allowing selective supply and/or interruption of the steam to the respective steam supply pipes be further provided at the region where the auxiliary steam supply pipe 620 diverges from the primary steam supply pipe 610.

This is because the steam may be supplied from the bottom part of the drum 300, the steam may be supplied from the top part of the drum 300, or the steam may be supplied simultaneously from the top and bottom parts of the drum 300 according to the corresponding operation.

The flow direction control valve may adjust the opening degree of the pipe lines to control the amount of the steam supplied.

Consequently, the laundry machine with the above-stated construction according to the first preferred embodiment of the present invention has an advantage in that the steam can be supplied simultaneously to the upper space of the drum 300 and the lower space of the drum 300, and therefore, the steam can be uniformly supplied to the upper and lower parts of the laundry, whereby the washing efficiency is improved.

On the other hand, the structure of laundry machine according to the above-described first preferred embodiment of the present invention may be changed in various manners.

Figure 11:
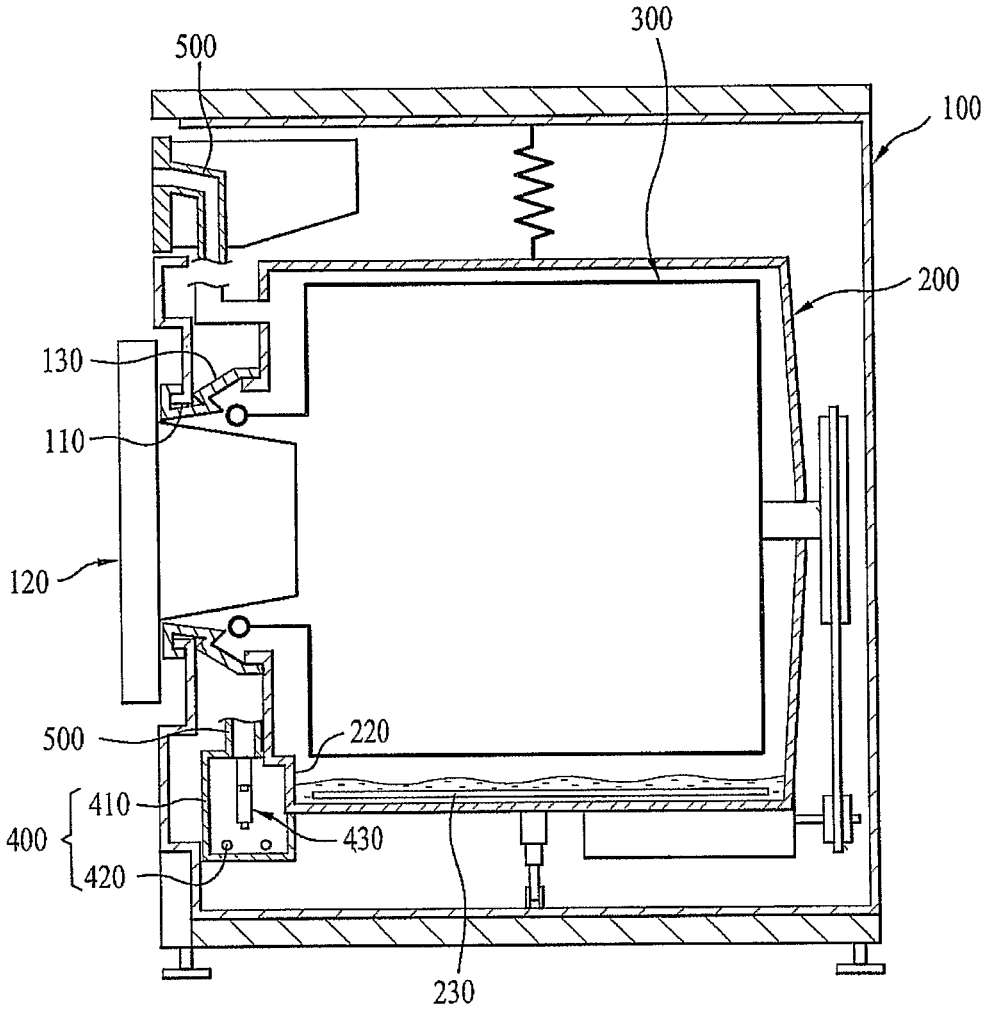
FIG. 11 is a side view, in section, illustrating the interior structure of another modified example of the laundry machine according to the first preferred embodiment of the present invention.

First, FIG. 11 illustrates a modified example of the laundry machine according to the first preferred embodiment of the present invention.

According to the modified example shown in FIG. 11, the steam supply unit 400 is located approximately at the same height as or lower than the bottom part of the drum in the machine body 100. Furthermore, the water inlet pipe 500 communicates with the upper front part of the machine body 100, and therefore, the water inlet pipe 500 is exposed to the outside.

This structure illustrates that the water inlet position can be changed. The water inlet side of the water inlet pipe 500 is not restricted to a specific region but may be located at any one of all the sides of the machine body 100.

In addition, although not shown, the water inlet side of the water inlet pipe 500 may be divided into a plurality of water inlet branches such that the water inlet pipe 500 can communicate simultaneously with one or more sides of the machine body 100.

Figure 12:
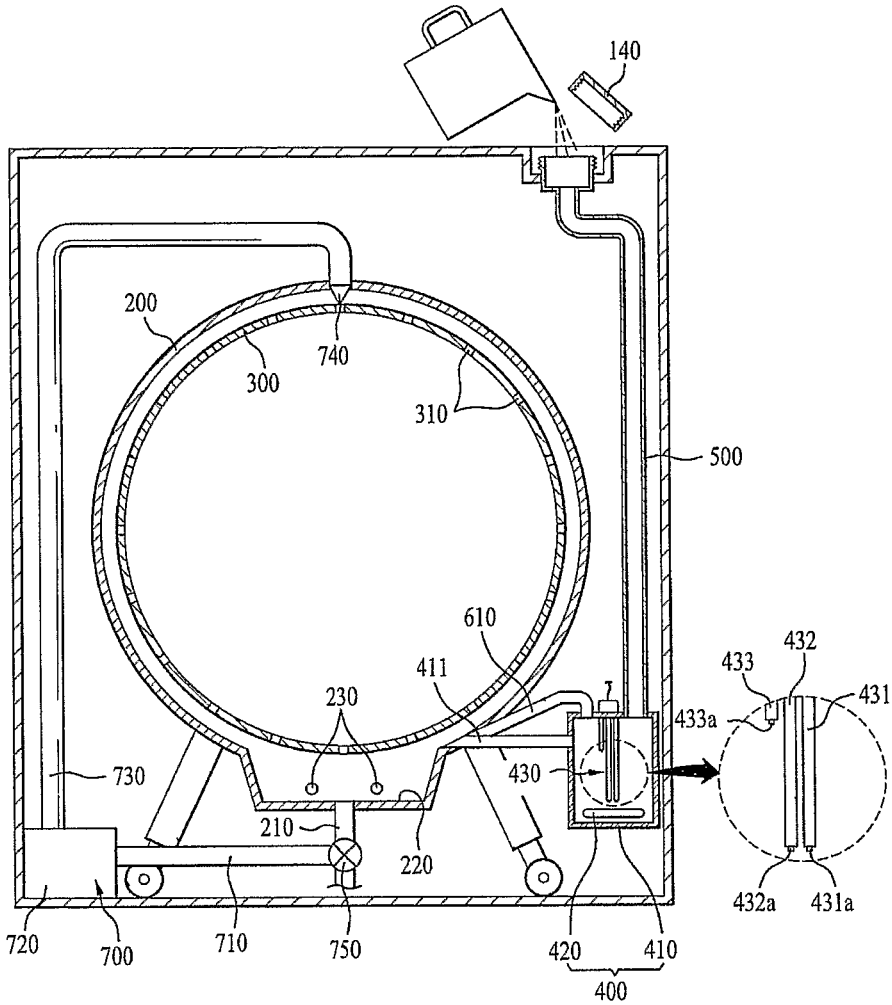
FIGS. 12 and 13 are front views, in section, illustrating the interior structure of a third modified example of the laundry machine according to the first preferred embodiment of the present invention.
Figure 13:
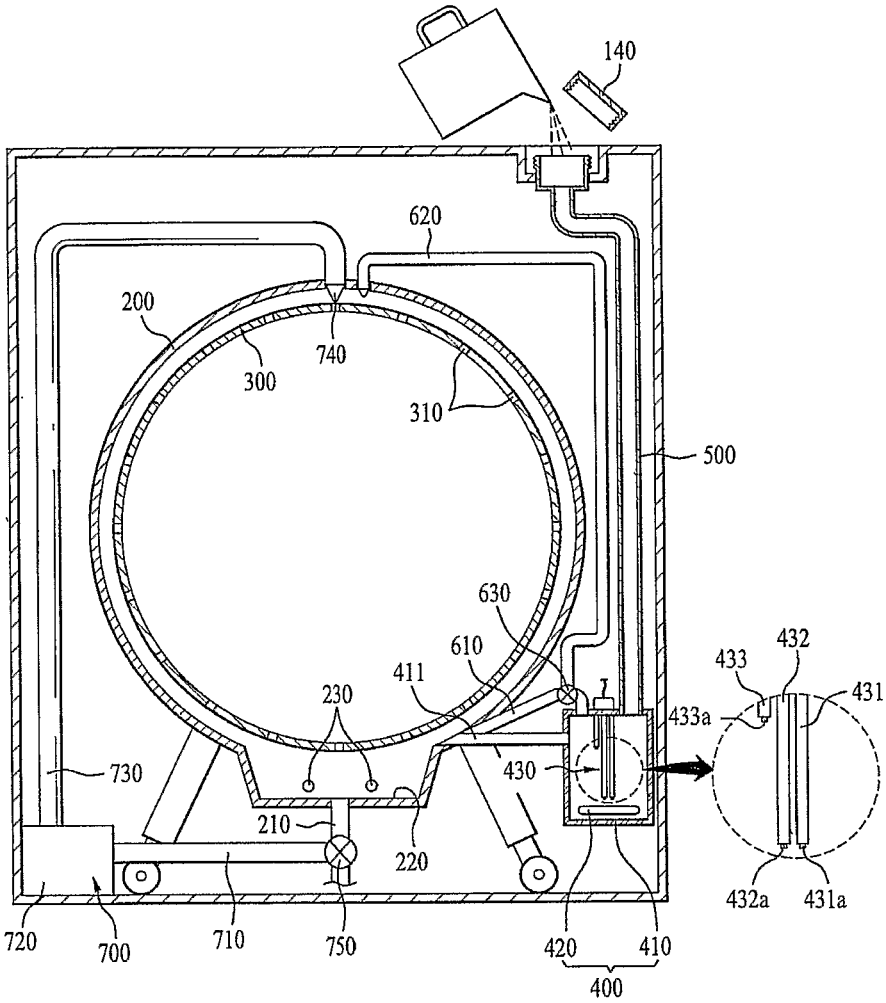

FIGS. 12 and 13 illustrate a modified example of the laundry machine according to the first preferred embodiment of the present invention, which further comprises a construction for washing water circulation.

Specifically, the laundry machine according to the present invention shown in FIGS. 12 and 13 further comprises a washing water circulation unit 700 mounted in the machine body 100 for circulating the washing water in the tub 200 such that the washing water can be injected into the drum 300 in addition to the above-described structure of the laundry machine according to the first preferred embodiment of the present invention.

The washing water circulation unit 700 is a structure for injecting the washing water into the drum 300 when the laundry is wetted and/or when the washing operation is carried out, whereby the wetting process of the laundry is more smoothly carried out, and therefore, the washing efficiency is improved.

In this case, the washing water circulation unit 700 includes an inlet pipe 710 for receiving the washing water from the tub 200, a circulating pump 720 mounted on the pipe line of the inlet pipe 710 for pumping the washing water, a guide pipe 730 for guiding the washing water pumped by the circulating pump 720 to the upper space of the machine body 100, and an injection nozzle 740 coupled to the discharge side of the guide pipe 730 and extending through the gasket 130, such that the injection nozzle 740 can communicate with the inside upper end of the drum 300, for injecting the pumped washing water.

Preferably, the inlet pipe 701 is connected to the water drainage pipe 210 such that the inlet pipe 701 can communicate with the water drainage pipe 210. Also preferably, an on-off valve 750 is mounted on the pipe line of the inlet pipe 710 or the pipe line of the water drainage pipe 210 for selectively opening and closing the two pipe lines.

Figure 14:
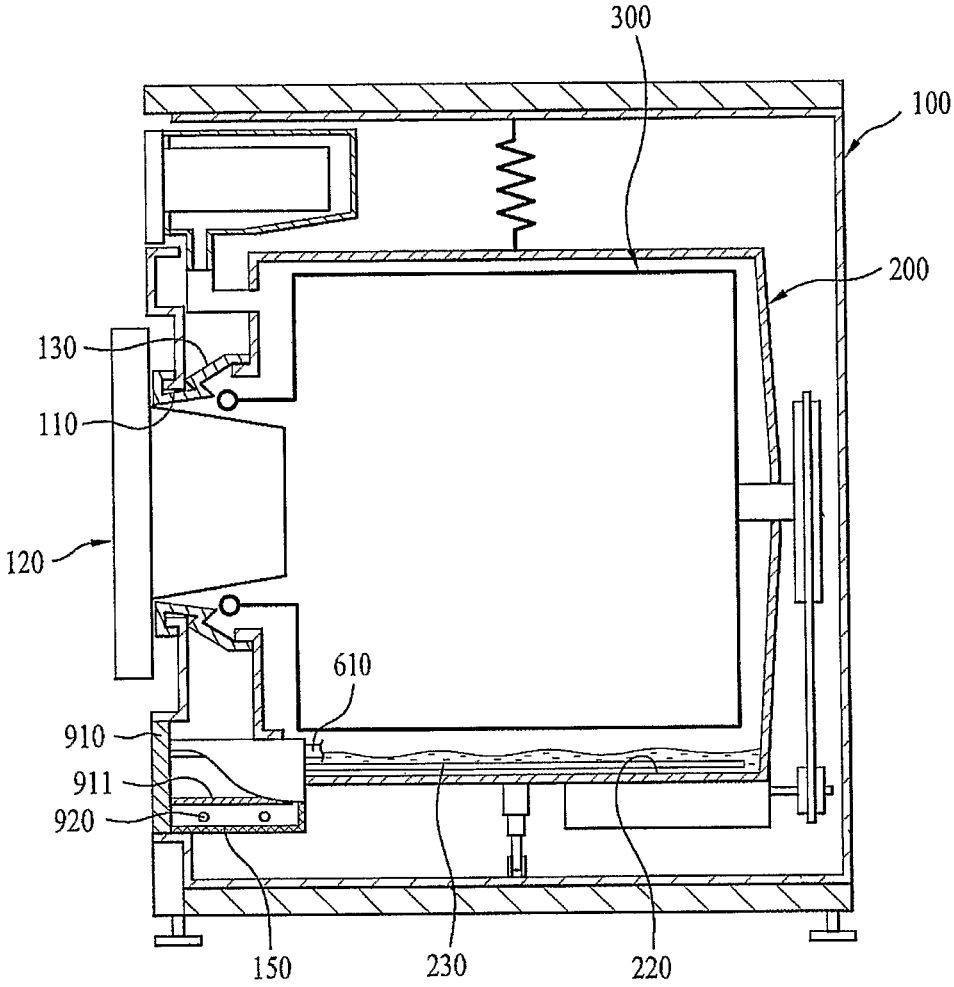
FIG. 14 is a side view, in section, illustrating the interior structure of a fourth modified example of the laundry machine according to the first preferred embodiment of the present invention.
Figure 15:
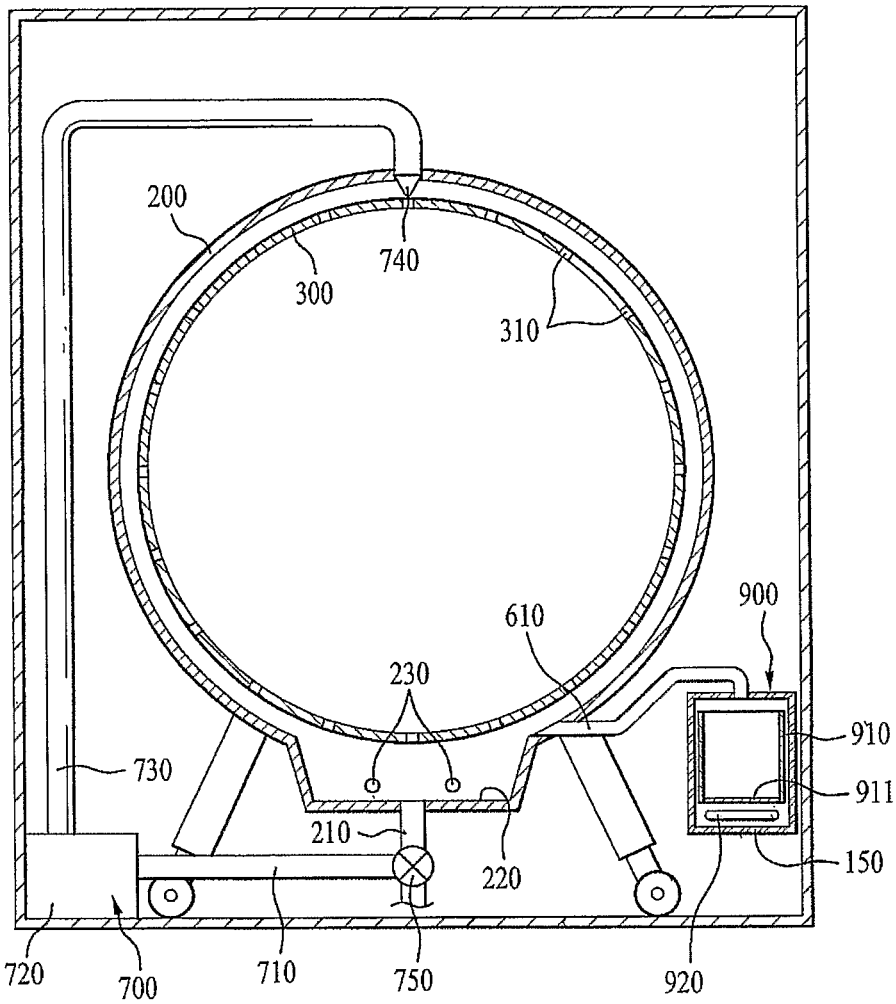
FIG. 15 is a front view, in section, illustrating the interior structure of a fifth modified example of the laundry machine according to the first preferred embodiment of the present invention.

FIGS. 14 and 15 illustrate a steam supply unit detachably attached to the machine body of the laundry machine according to the first preferred embodiment of the present invention.

Specifically, in this example, the steam supply unit 900 includes a case 910 and a heater 920. The case 910 is detachably attached to the machine body 100, which will be described below in detail.

First, the case 910 of the laundry machine shown in FIGS. 14 and 15 is received in the machine body 100 through one side of the machine body 100.

Preferably, the case 910 is received in the machine body 100 in a drawer-type inserting fashion through the lower front part (preferably, the lower front corner) of the machine body 100 such that the user can easily and conveniently manipulate the case 910.

Preferably, a guide part 150 is mounted in the machine body 100 for guiding the location position of the case 910 while supporting the opposite sides of the bottom of the case 910 when the case 910 is inserted into the machine body. Preferably, the guide part 150 is formed in the shape of a box having a predetermined receiving space defined therein.

Also, the heater 920 is constructed to heat the water stored in the case 910 into steam.

Consequently, when the case 910 is inserted into the machine body 100, the heater 920 may be located in the bottom space of the guide part 150, which is the lower part of the case 910.

In this case, it is preferable that the bottom of the case 910 be made of a metal material having high thermal conductivity.

Of course, although not shown, the heater 920 may be integrally fixed in the case 910.

Also, one end of the primary steam supply pipe 610, which guides the discharge of the steam, is connected to the guide part 150 such that the primary steam supply pipe 610 communicates with the interior space of the guide part 150, and the other end of the primary steam supply pipe 610 is connected to the tub 200 such that the primary steam supply pipe 610 communicates with the interior space of the tub 200.

Preferably, the other end of the primary steam supply pipe 610 is connected to the tub 200 through the lower circumferential part of the tub 200 such that the steam supply pipe 610 communicates with the interior of the tub 200.

Of course, the laundry machine shown in FIGS. 14 and 15 may further comprise an auxiliary steam supply pipe 620 for injecting the steam into the drum 300 through the upper space of the tub 200.

It is preferable that the auxiliary steam supply pipe 620 diverge from a predetermined region of the pipe line of the primary steam supply pipe 610. It is also preferable that a flow direction control valve 630 for allowing selective supply and/or interruption of the steam to the respective steam supply pipes be further provided at the region where the auxiliary steam supply pipe diverges from the primary steam supply pipe. Preferably, the discharge end of the auxiliary steam supply pipe 620 extends through the gasket 130 such that the auxiliary steam supply pipe communicates with the interior of the drum 300.

Also, the laundry machine shown in FIGS. 14 and 15 further comprises a washing water circulation unit 700 mounted in the machine body 100 for circulating the washing water in the tub 200 such that the washing water can be injected into the drum 300.

The washing water circulation unit 700 includes an inlet pipe 710 for receiving the washing water from the tub 200, a circulating pump 720 mounted on the pipe line of the inlet pipe 710 for pumping the washing water, a guide pipe 730 for guiding the washing water pumped by the circulating pump 720 to the upper space of the machine body 100, and an injection nozzle 740 coupled to the discharge side of the guide pipe 730 and extending through the gasket 130, such that the injection nozzle 740 can communicate with the inside upper end of the drum 300, for injecting the pumped washing water.

As can be understood from the above description, the laundry machine according to the present invention can be modified in various manners.

Hereinafter, a laundry machine according to a second preferred embodiment of the present invention will be described with reference to FIG. 16.

Figure 16:
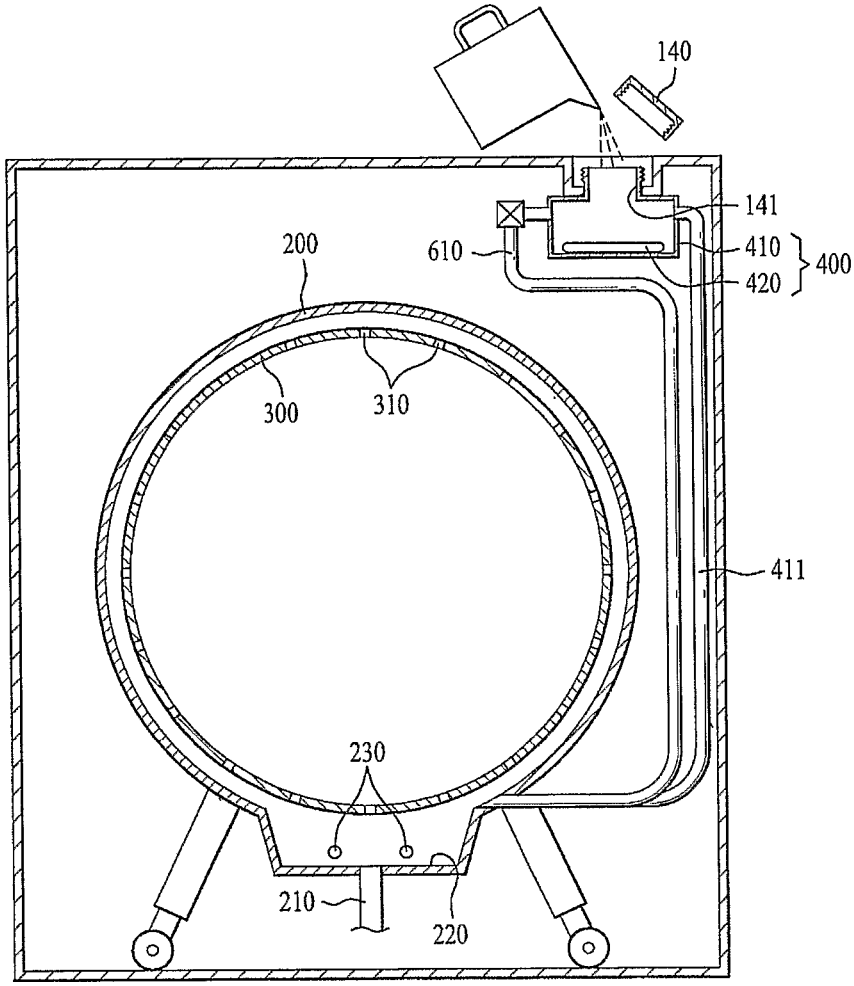
FIG. 16 is a front view, in section, illustrating the interior structure of a laundry machine according to a second preferred embodiment of the present invention.

The reference numbers of FIG. 16, which are identical to those of the previously described first preferred embodiment, indicate the same structural components as the first preferred embodiment, and the structural components having the same reference numbers as the first preferred embodiment perform the same functions as the first preferred embodiment.

In this embodiment, as shown in FIG. 16, the case 410 and the heater 420 are located at the upper part of the machine body. More specifically, the case and the heater are located above the tub.

In order to supply water to the steam supply unit 400 including the case and the heater, the user can open the cover part 140, and then directly supply the water to the case through the water inlet port 141.

The second preferred embodiment of the present invention is characterized in that the steam supply unit is disposed at the upper part of the machine body, which is unlike the previously described first preferred embodiment. Other constructions and features of the first preferred embodiment may be applied to the second preferred embodiment of the present invention.

INDUSTRIAL APPLICABILITY

It is included in the detailed description of the invention.

What is claimed is:

1. A drying machine for drying laundry and supplying steam to wrinkled dry laundry, comprising:

a machine body;

a drum mounted in the machine body to receive laundry, the drum being rotatable around a horizontal axis;

a steam generator mounted in a lower portion of the machine body to generate steam, the steam generator being constructed to receive water manually supplied by a user through a water inlet port exposable to an outside of the machine body and including a case constructed to receive the water through the water inlet port and a heater to heat the water to generate steam;

a single primary steam supply part to directly supply the steam into the drum from the steam generator to remove wrinkles from laundry in the drum, wherein the water inlet port is arranged at an upper surface or at an upper front part of the machine body without protruding outward above the upper surface of the machine body;

a cover part to allow selective communication between the water inlet port and the outside; and a water inlet pipe, having one end communicating with the water inlet port and the other end communicating with the case, to supply water to the case from the water inlet port, wherein the case is located approximately at a position lower than a middle part of the machine body, wherein the drying machine requires the water supply be manually provided only to the steam generator.

2. The drying machine according to claim 1, wherein the case is located substantially at a position lower than the bottom of the drum.

3. The drying machine according to claim 1, wherein the case is provided with an overflow pipe to allow oversupplied water to overflow therethrough.

4. The drying machine according to claim 1, further comprising:

a water level detector to detect a water level of water received in the case.

5. The drying machine according to claim 4, wherein the heater is controlled based on the water level detected by the water level detector.

6. The drying machine according to claim 4, wherein the water level detector includes an electrode sensor having at least two electrodes.

7. The drying machine according to claim 4, further comprising:

a display to display a water level to inform a user of the information detected by the water level detector.

8. The drying machine according to claim 1, further comprising:

an auxiliary steam supply part to supply the steam into the drum through an upper side of the drum.

9. The drying machine according to claim 8, wherein the auxiliary steam supply part includes an auxiliary steam supply pipe diverging from the primary steam supply part.

10. The drying machine according to claim 9, further comprising:

a flow direction control valve mounted at a region where the auxiliary steam supply pipe diverges from the primary steam supply pipe to selectively open and close the respective pipe lines or to control an opening degree of the respective pipe lines.

11. The drying machine according to claim 1, wherein the one end of the water inlet pipe is directly connected to the water inlet port and the other end of the water inlet pipe is directly connected to the case of the steam generator.

12. A drying machine for drying laundry and supplying steam to wrinkled dry laundry, comprising:

a machine body including an upper wall, a lower wall, and a plurality of side walls;

a drum mounted in the machine body to receive laundry, the drum being rotatable around a horizontal axis;

a steam generator mounted in a lower portion of the machine body to generate steam, the steam generator being constructed to receive water manually supplied by a user through a water inlet port exposable to an outside of the machine body and including a case constructed to receive the water through the water inlet port and a heater to heat the water to generate steam;

a single primary steam supply part to directly supply the steam into the drum from the steam generator to remove wrinkles from laundry in the drum, wherein the water inlet port is recessed in the upper wall of the machine body or at an upper front part of the machine body without protruding outward above an upper surface of the upper wall of the machine body;

a cover part to allow selective communication between the water inlet port and the outside; and a water inlet pipe, having one end communicating with the water inlet port and the other end communicating with the case, to supply water to the case from the water inlet port, wherein the case is located approximately at a position lower than a middle part of the machine body, wherein the drying machine requires the water supply be manually provided only to the steam generator.

* * * * *